US010124267B1

(12) United States Patent
Bachman

(10) Patent No.: US 10,124,267 B1
(45) Date of Patent: Nov. 13, 2018

(54) REMOTE-CONTROL RACE GAME SYSTEM AND METHODS OF USING SAME

(71) Applicant: Theodore L. Bachman, Easton, PA (US)

(72) Inventor: Theodore L. Bachman, Easton, PA (US)

( * ) Notice: Subject to any disclaimer, the term of this patent is extended or adjusted under 35 U.S.C. 154(b) by 0 days.

(21) Appl. No.: 15/591,327

(22) Filed: May 10, 2017

(51) Int. Cl.

| | |
|---|---|
| ***A63H 17/30*** | (2006.01) |
| ***A63H 17/38*** | (2006.01) |
| ***A63H 30/04*** | (2006.01) |
| ***A63F 9/14*** | (2006.01) |

(52) U.S. Cl.
CPC ..... *A63H 17/30* (2013.01); *A63F 9/143* (2013.01); *A63H 17/38* (2013.01); *A63H 30/04* (2013.01); *A63F 2250/52* (2013.01)

(58) Field of Classification Search
CPC ..... A63H 17/30; A63H 17/38; A63H 30/04; A63F 2250/52
See application file for complete search history.

(56) References Cited

U.S. PATENT DOCUMENTS

| | | | | |
|---|---|---|---|---|
| 4,247,107 | A | 1/1981 | Smith, III et al. | |
| 4,295,649 | A | 10/1981 | Cooper | |
| 6,059,657 | A | 5/2000 | Oh et al. | |
| 6,109,186 | A | 8/2000 | Smith et al. | |
| 6,688,985 | B2 | 2/2004 | Weiss et al. | |
| 7,402,106 | B2 | 7/2008 | Weisel, Jr. et al. | |
| 2004/0156467 | A1* | 8/2004 | Freifeld | A63H 18/005 377/100 |
| 2005/0215327 | A1* | 9/2005 | Weisel, Jr. | A63H 18/02 463/58 |
| 2010/0130096 | A1* | 5/2010 | Baarman | A63H 17/26 446/444 |

OTHER PUBLICATIONS

FYI—R/C Rock Crawling Competition Rules, Online Forum Discussion by TNCrawler, Oct. 17, 2011, retrieved from (https://www.rcsparks.com/forum/threads/fyi-r-c-rock-crawling-competition-rules.6163/.*

* cited by examiner

*Primary Examiner* — Jasson Yoo
(74) *Attorney, Agent, or Firm* — James R. McDaniel

(57) ABSTRACT

A method of playing a remote-control race game system, including the steps of: determining a number of players/drivers to participate in a remote-control race; selecting, by each player/driver, a vehicle/player console, wherein each vehicle/player console remotely controls a particular motorized vehicle; determining an amount of time for the remote-control race; determining a number of predetermined targets that have been crossed over or through by each of the particular motorized vehicles; determining if the amount of time for the remote-control race has expired; determining the number of points earned by each of the particular motorized vehicles; and determining which of the particular motorized vehicles earned the most number of points.

13 Claims, 5 Drawing Sheets

REMOTE-CONTROL RACE GAME SYSTEM AND METHODS OF USING SAME

FIELD OF THE INVENTION

The present invention is generally related to a remote-control race game system. The remote-control race game system allows players to compete against each other by attempting to maneuver their motorized vehicle across as many predetermined targets as possible. The race is timed by a master timer and all of the motorized vehicles start at the same time. The motorized vehicles will become disabled when the time has expired. The object of the race game is to maneuver around the other active motorized vehicles being played and also those that are not being played and remain stationary on the playfield. While driving in the preferred direction, the motorized vehicle will be crossing over or through predetermined targets on the playfield surface that will award points to the player driving that particular motorized vehicle. The driver/player with the highest score wins the race.

BACKGROUND OF THE INVENTION

Prior to the present invention, as set forth in general terms above and more specifically below, it is known, to employ various types of remote-control race game systems. See for example, U.S. Pat. No. 4,247,107 by Smith, III et al., U.S. Pat. No. 4,295,649 by Cooper, U.S. Pat. No. 6,059,657 by Oh et al., U.S. Pat. No. 6,109,186 by Smith et al., U.S. Pat. No. 6,688,985 by Weiss et al., and U.S. Pat. No. 7,402,106 by Weisel, Jr. et al. While these various remote-control race game systems may have been generally satisfactory, there is nevertheless a need for a new and improved remote-control race game system that allows players to compete against each other by attempting to maneuver their motorized vehicle through or across as many predetermined targets as possible while maneuvering his/her motorized vehicle around the other active motorized vehicles being played and also those that are not being played and remain stationary on the playfield. In this manner, the motorized vehicle crossing over or through predetermined targets on the playfield surface will be awarded points to the player/driver driving that particular motorized vehicle so that the driver/player with the highest score wins the game.

It is a purpose of this invention to fulfill these and other needs in the speculum art in a manner more apparent to the skilled artisan once given the following disclosure.

BRIEF SUMMARY OF THE INVENTION

A first aspect of the present invention is a method of playing a remote-control race game system, including the steps of: determining a number of players/drivers to participate in a remote-control race; selecting, by each player/driver, a vehicle/player console, wherein each vehicle/player console remotely controls a particular motorized vehicle; determining an amount of time for the remote-control race; determining a number of predetermined targets that have been crossed over or through by each of the particular motorized vehicles; determining if the amount of time for the remote-control race has expired; determining the number of points earned by each of the particular motorized vehicles; and determining which of the particular motorized vehicles earned the most number of points.

In one embodiment of the first aspect of the present invention, the step of determining the number of predetermined targets that have been crossed over or through by each of the particular motorized vehicles includes the steps of determining the type and number of predetermined targets, and determining the locations of the predetermined targets.

In another embodiment of the first aspect of the present invention, the method further includes the step of determining a layout of a playfield upon which the predetermined targets are to be located.

In another embodiment of the first aspect of the present invention, the step of determining the number of predetermined targets that have been crossed over or through by each of the particular motorized vehicles further includes the step of awarding a point value for each of the predetermined targets that have been crossed over or through by each of the particular motorized vehicles.

In another embodiment of the first aspect of the present invention, the step of determining the number of predetermined targets that have been crossed over or through by each of the particular motorized vehicles further includes the step of determining if the particular motorized vehicle has traveled in the wrong direction.

In still another embodiment of the first aspect of the present invention, the step of determining if the particular motorized vehicle has traveled in the wrong direction further includes the step of determining if the particular motorized vehicle has crossed over or through at least two predetermined targets in the wrong direction.

In an even further embodiment of the first aspect of the present invention, the step of determining if the particular motorized vehicle has traveled in the wrong direction further includes the step of disabling the particular motorized vehicle for a predetermined period of time.

In a still further embodiment of the first aspect of the present invention, the step of determining the number of predetermined targets that have been crossed over or through by each of the particular motorized vehicles further includes the step of determining if the particular motorized vehicle has backed up.

In a yet further embodiment of the first aspect of the present invention, the step of determining if the particular motorized vehicle has backed up further includes the step of determining if the particular motorized vehicle has crossed over or through only one predetermined target in the wrong direction.

In a still yet further embodiment of the first aspect of the present invention, the step of determining if the particular motorized vehicle has backed up further includes the step of deducting a point value if it is determined that the particular motorized vehicle has backed up.

In a still yet further embodiment of the first aspect of the present invention, the method includes the step of determining if the particular motorized vehicle has a front-end collision while moving in the forward direction.

In an even yet further embodiment of the first aspect of the present invention, the step of determining if the particular motorized vehicle has a front-end collision while moving in the forward direction further includes the step of deducting a point value if it is determined that the particular motorized vehicle has hit another motorized vehicle or object while traveling in the forward direction.

In another further embodiment of the first aspect of the present invention, the method includes the step of determining if the particular motorized vehicle has a rear end collision while moving in the forward direction.

In an even yet further embodiment of the first aspect of the present invention, the step of determining if the particular motorized vehicle has a rear end collision while traveling in the forward direction further includes the step of not deducting a point value if it is determined that the particular motorized vehicle was hit by another motorized vehicle in the rear while traveling in the forward direction.

Determining if the particular motorized vehicle has a rear end collision while moving in the reverse direction.

Determining if the particular motorized vehicle has a rear end collision while traveling in the reverse direction further includes the step of deducting a point value if it is determined that the particular motorized vehicle has hit another motorized vehicle or object while traveling in the reverse direction.

In another yet further embodiment of the first aspect of the present invention, the step of determining the number of points earned by each of the particular motorized vehicles further includes the steps of; determining if more than one of the number of players/drivers has earned the same number of points, determining the amount of extra time to be run in an extra time period, and determining, again, if more than one of the number of players/drivers has earned the same number of points.

A second aspect of the present invention is a method of operating a remote-control race game for use by a number of players to simulate a race, including the steps of: determining a number of players/drivers to participate in a remote-control race; selecting, by each player/driver, a vehicle/player console, wherein each vehicle/player console remotely controls a particular motorized vehicle; determining an amount of time for the remote-control race; determining a number of predetermined targets that have been crossed over or through by each of the particular motorized vehicles; determining if the amount of time for the remote-control race has expired; determining the number of points earned by each of the particular motorized vehicles; and determining which of the particular motorized vehicles earned the most number of points.

In one embodiment of the second aspect of the present invention, the step of determining the number of predetermined targets that have been crossed over or through by each of the particular motorized vehicles includes the steps of determining the type and number of predetermined targets, and determining the locations of the predetermined targets.

In another embodiment of the second aspect of the present invention, the step of determining the number of predetermined targets that have been crossed over or through by each of the particular motorized vehicles further includes the step of awarding a point value for each of the predetermined targets that have been crossed over or through by each of the particular motorized vehicles.

In another embodiment of the second aspect of the present invention, the step of determining the number of predetermined targets that have been crossed over or through by each of the particular motorized vehicles further includes the step of determining if the particular motorized vehicle has traveled in the wrong direction.

In even further embodiment of the second aspect of the present invention, the step of determining if the particular motorized vehicle has traveled in the wrong direction further includes the step of determining if the particular motorized vehicle has crossed over or through at least two predetermined targets in the wrong direction.

In still another embodiment of the second aspect of the present invention, the step of determining the number of predetermined targets that have been crossed over or through by each of the particular motorized vehicles further includes the step of determining if the particular motorized vehicle has backed up.

In yet another embodiment of the second aspect of the present invention, the step of determining if the particular motorized vehicle has backed up further includes the step of determining if the particular motorized vehicle has crossed over or through only one predetermined target in the wrong direction.

A third aspect of the present invention is a remote-control race game for use by a number of players to simulate a race, including a plurality of remote-control motorized vehicles, each selectively controlled by one a plurality of players, wherein each of the plurality of motorized vehicles includes a predetermined target sensor, a plurality of race vehicle player consoles each operatively connected to one of the plurality of motorized vehicles, wherein each of the race vehicle player consoles includes a steering mechanism, a race playfield, wherein the race playfield further includes a plurality of predetermined targets located at predetermined locations around the race playfield such that the plurality of predetermined targets can be crossed over or through by the motorized vehicle and the plurality of predetermined targets can be detected by the predetermined target sensor of the motorized vehicle, and a race control system operatively connected to the plurality of motorized vehicles and the plurality of race vehicle player consoles.

In one embodiment of the third aspect of the present invention, the plurality of predetermined targets further includes a plurality of lines such that each of the lines includes a wide line section and a thin line section.

The preferred remote-control race game system, according to various embodiments of the present invention, offers the following advantages: ease of operation; ease of use; durability; excellent race game characteristics; the ability to sense when the motorized vehicle has crossed over or through the predetermined target(s); the ability to provide information to the player/driver as to the number of predetermined targets that have been crossed over or through by that particular player/driver's motorized vehicle; the ability to control the speed of each player/driver's motorized vehicle so that all of the motorized vehicles are traveling at the same speed; the ability to provide a penalty box for those players/drivers that drive their vehicles in the wrong direction; the ability to deduct a point from those players/drivers that back up their vehicle; and the ability to adjust the remote-control race game system to adjust to the ability of the players/drivers. In fact, in many of the preferred embodiments, these advantages are optimized to an extent that is considerably higher than heretofore achieved in prior, known remote-control race game systems.

BRIEF DESCRIPTION OF THE DRAWINGS

The above-mentioned features and steps of the invention and the manner of attaining them will become apparent, and the invention itself will be best understood by reference to the following description of the embodiments of the invention in conjunction with the accompanying drawings, wherein like characters represent like parts throughout the several views and in which.

DETAILED DESCRIPTION OF THE PREFERRED EMBODIMENTS OF THE INVENTION

Figure 1:
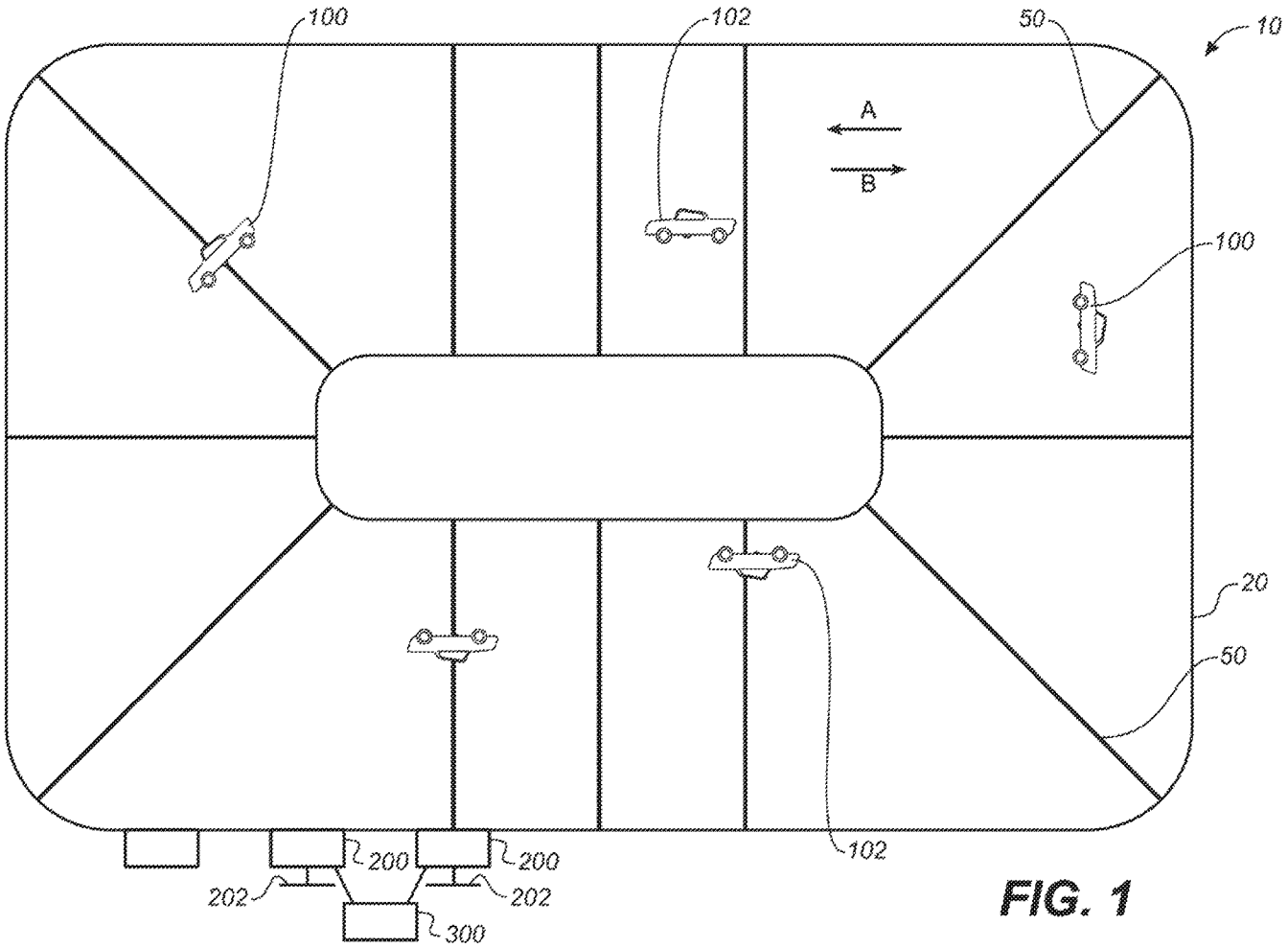
FIG. 1 is a schematic illustration of the remote-control race game system, constructed according to the present invention.

Referring now to FIG. 1, there is illustrated a remote-controlled race game system 10. As will be explained hereinafter in greater detail, remote-controlled race game system 10 allows players to compete against each other by attempting to maneuver their motorized vehicle 100 across or through as many predetermined targets 50 as possible while maneuvering his/her motorized vehicle 100 around the other active motorized vehicles 100 being played and also those motorized vehicles 102 that are not being played and remain stationary on the playfield. In this manner, the motorized vehicle 100 crossing over or through predetermined targets 50 on the playfield 20 will be awarded points to the player/driver driving (or controlling) that particular motorized vehicle 100 so that the driver/player with the highest score wins the game.

As shown in FIG. 1, there is illustrated a remote-controlled race game system 10 that is constructed according to the present invention. Remote-controlled race game system 1 includes, in part, race playfield 20, predetermined targets 50, remote-controlled race vehicles 100 and 102, race vehicle player consoles 200 and race control system 300.

With respect to race playfield 20, race playfield 20 is constructed of any suitable, durable, lightweight, wear resistant material. For example, for wheeled vehicles, the playfield 20 can be constructed of materials to create a suitable flat surface, such as plywood, fiberglass, or plastics. For marine and amphibious vehicles, playfield materials of construction would include fiberglass and/or vinyl liner covered wood, aluminum, plastic or fiberglass. For airborne vehicles, such as quadcopters, helicopters, inflatables, or drones, a suitable takeoff and landing platform could consist of wood, metal, fiberglass, or plastic. A structure to encapsulate the playfield 20 with fence, netting, or clear plastic can also be made of the same materials of construction. Preferably, race playfield 20 is constructed in the shape of an oval to replicate the oval shape of many real-life race playfields. However, it is to be understood that the shape of race playfield 20 can be configured in many different shapes and still provide the unique inventive aspects of the present invention.

Figure 2:
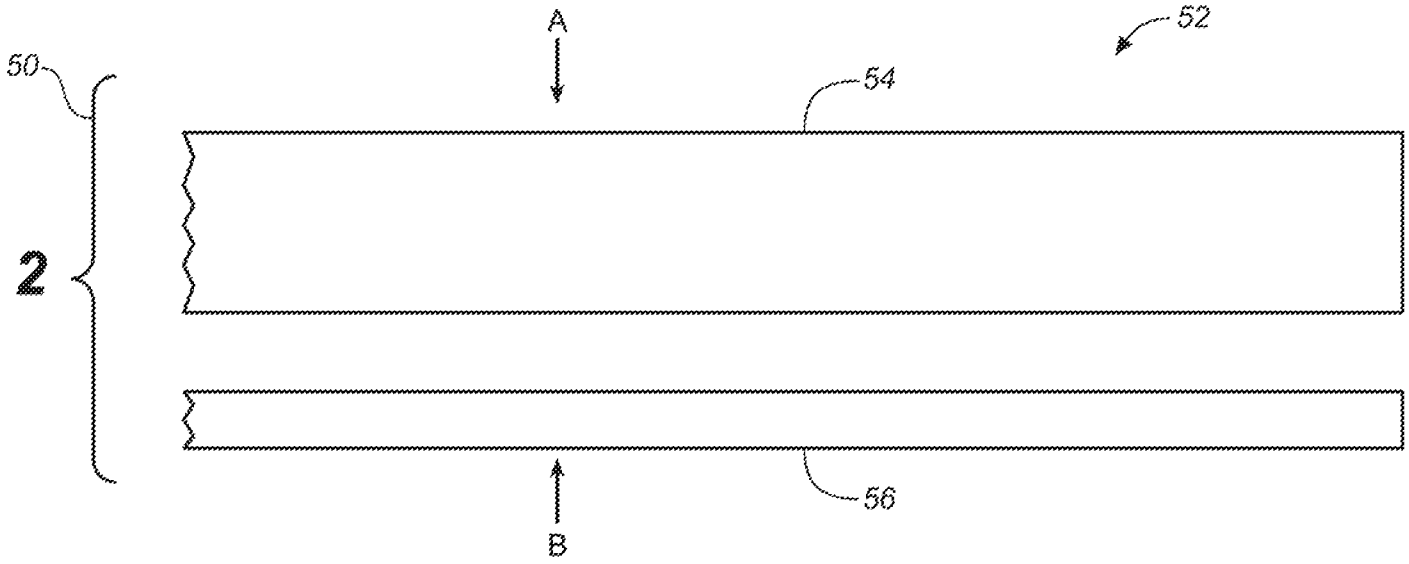
FIG. 2 is a detailed view of an exemplary predetermined target such as a line, constructed according to the present invention.

With respect to FIGS. 1 and 2, located on race playfield 20 are a plurality of predetermined targets 50. Preferably, there are at least two (2) predetermined targets 50. However, it is to be understood that the number of predetermined targets 50 can vary and still provide the unique inventive aspects of the present invention. Preferably, predetermined targets 50 are a plurality of lines 52 (FIG. 2). However, it is to be understood that other types of mechanical and/or electrical predetermined targets 50 such as laser beams, computer generated targets, light/sound emitters, lights, illuminations, graphical symbols marks or symbols, signs, or the like can be used as predetermined targets 50. It is to be further understood that the predetermined targets 50 can also include physical objects in which the motorized vehicle 100 passes through the target 50 such as buoys, docks, and other floating objects for marine vehicles. Pass through predetermined targets 50 for airborne motorized vehicles can include elevated hoops and structures. Predetermined targets 50 for ground motorized vehicles can include bridges, pylons or gates, and themed structures. However, it is to be understood that whatever type of predetermined target 50 is used, the predetermined target 50 must be able to be crossed over or through or otherwise interacted with by the motorized vehicle 100 so that the remote-controlled race game system 10 can determine that a player's/driver's motorized vehicle 100 has actually crossed over or through that particular predetermined target 50.

As shown in FIG. 2, there is illustrated a preferred construction of lines 52. As shown in FIG. 2, each of the lines 52 includes, in part, a wide line section 54 and a thin line section 56. As will be described in greater detail later, one of the unique aspects of the present invention is the use of the wide line section 54 and a thin line section 56. In particular, as the motorized vehicles 100 are traveling around race playfield 20 in the direction of arrow (A), the motorized vehicle 100 will sense that it has encountered predetermined target 50 (in this example, line 52). In order to determine that a particular motorized vehicle 100 is traveling in the correct direction (the direction of arrow (A)), the motorized vehicle 100 must first detect the presence of the wide line section 54 of a particular line 52 and then the thin line section 56 of the particular line 52. If this occurs, the player/driver of that particular motorized vehicle 100 is awarded a point, as will be described later. However, if the particular motorized vehicle 100 is traveling in the wrong direction or is backing up to get around an obstacle such as a stationary vehicle 102 (the direction of arrow (B)), the motorized vehicle will then detect the presence of the thin line section 56 of a particular line 52 and then the wide line section 54 of the particular line 52. If this occurs, the player/driver of that particular motorized vehicle is either placed in the penalty box or a point is deducted, as will be described later.

Regarding race vehicle player consoles 200, each of the race vehicle player consoles 200 are operatively connected to one of the motorized vehicles 100, 102 through a conventional wireless connection. For an exemplary embodiment, the player consoles 200 are conventionally wired to electronic input modules (not shown) which communicate the player's commands via the Ethernet to the race control system 300. The race control system 300 then transmits the commands wirelessly to the motorized vehicle transmitter/receiver 110. In this manner, a particular race vehicle player console 200 is able to remotely control a particular motorized vehicle 100. Located on each of the race vehicle player consoles 200 is a conventional motorized vehicle steering mechanism 202. Preferably, the motorized vehicle steering mechanism 202 is a steering wheel but it is to be understood that other suitable types of steering mechanisms such as joy sticks, hand controllers, knobs, steering spinners or like can also be utilized.

Each of the race vehicle player consoles 200 is conventionally connected to a race control system 300 that controls the race parameters such as the time of each race, the number of active motorized vehicles 100 in each race, the number of inactive motorized vehicles 102 in each race, the type and amount of predetermined targets 50 in each race, the speed of each of the motorized vehicles 100 (propulsion control), the number of predetermined targets 50 that have been crossed over or through by a particular motorized vehicle 100, the direction of travel of a particular motorized vehicle 100, bonus time period enabled/disabled, bonus points per target, penalty box parameters, sudden death parameters, high score to beat parameters, frontal and rear end collision penalty parameters, digital sound, attraction lighting and the like.

Figure 3:
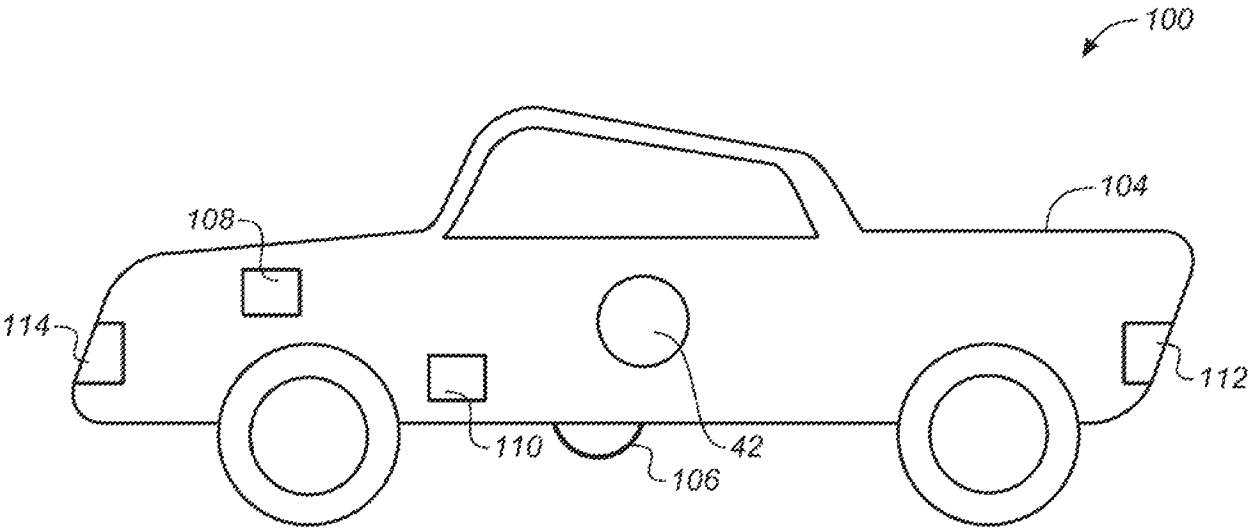
FIG. 3 is a schematic illustration of an exemplary motorized vehicle such as a race vehicle, constructed according to the present invention.

With respect to FIGS. 1 and 3, there is illustrated motorized vehicle 100. Motorized vehicle 100 includes, in part, vehicle 104 having a predetermined target sensor 106, a motor 108, a transmitter/receiver 110 and frontal and rear collision sensors 112, 114. It is to be understood that motorized vehicles 102 will also include the same components as motorized vehicle 100. In one embodiment of the present invention, vehicle 100 is a replica of a race vehicle. However, in other embodiments of the present invention, motorized vehicle 100 can also be a replica of an airplane, boat, hovercraft, a motorcycle, a helicopter, a truck, an aerial vehicle such as a drone, or the like. The important consideration regarding the type of motorized vehicle 100 is that the motorized vehicle 100 must be able to be controlled by the race vehicle player console 200 and the motorized vehicle 100 must be able to cross over, through, or otherwise interact with the predetermined targets 50.

Located on each of the motorized vehicles 100 is a predetermined target sensor 106. As will be described in greater detail later, predetermined target sensor 106 is used to sense or otherwise determine when the motorized vehicle 100 has crossed over or through or otherwise interacted with a predetermined target 50. In one embodiment, predetermined target sensor 106 is a conventional electrical/mechanical sensor that is capable of interacting with the predetermined target 50 so as to notify race control system 300 that a particular motorized vehicle 100 has crossed over or through or otherwise interacted with a predetermined target 50. In another embodiment, predetermined target sensor 106 can be, but is not limited to, a proximity sensor, a speed sensor, a global positioning sensor, an ultrasonic sensor, an infrared sensor, an electromagnetic sensor, an acoustic sensor, a magnetic sensor, a mechanical sensor, a position sensor, a thermal/heat sensor, an optical sensor, a light sensor or the like. It is to be further understood that predetermined targets 50 can be constructed in order to notify when a particular motorized vehicle 100 has crossed over, through, or otherwise interacted with the predetermined targets 50.

As an example, predetermined target sensor 106 can be, but is not limited to, a conventional object-type sensor that is capable of detecting the presence of predetermined target 50. In this example, predetermined target 50 is line 52 having wide line section 54 and thin line section 56. Under this example, as motorized vehicle 100 is traveling in the direction of arrow (A) around race playfield 20, predetermined target sensor 106 is able to detect the presence of wide line section 54 and then thin line section 56. In this manner, predetermined target sensor 106 is then able to inform race control system 300 that a particular motorized vehicle 100 has crossed over or through or otherwise interacted with a predetermined target 50 (line 52) and that the particular motorized vehicle 100 is traveling the correct direction (the direction of arrow (A)).

Also, located on motorized vehicle 100 is a conventional transmitter/receiver 110. As is well known in the remote-control vehicle art, the vehicle/player console 200 sends a conventional signal, such as a digital logic signal to the computer, which then sends the radio waves to the motorized vehicle 100. The conventional transmitter/receiver 110, which includes an antenna and circuit board (not shown), sits inside of the motorized vehicle 100 and it takes the signal from the conventional transmitter (not shown) operatively connected to the vehicle/player console 200. When the transmitter/receiver 110 gets the signal, the transmitter/receiver 110 conventionally activates the motor 108 and the steering mechanism (not shown) inside the motorized vehicle 100 depending on the signal that the transmitter gives out. Also, it is to be understood that transmitter/receiver 110 is used to transmit the signal back to the race control system 300 that a successful encounter with a target 50 was made in order for the score to be incremented/decremented.

With respect to front collision sensor 112 and rear collision sensor 114, front collision sensor 112 and rear collision sensor 114 are used to sense or otherwise determine when the motorized vehicle 100 has had a collision with an obstacle or another motorized vehicle 100. In one embodiment, front collision sensor 112 and rear collision sensor 114 are conventional electrical/mechanical sensors that are capable of determining if the particular motorized vehicle 100 has collided with an obstacle or another motorized vehicle 100 in the front or has been impacted by another motorized vehicle 100 in the rear so as to notify race control system 300 that a particular motorized vehicle 100 experienced a collision. Race control system 300 then determines the direction of travel of the motorized vehicle 100 that has experienced the collision. In another embodiment, front collision sensor 112 and rear collision sensor 114 can be, but is not limited to, a proximity sensor, an ultrasonic sensor, an infrared sensor, an electromagnetic sensor, an acoustic sensor, a magnetic sensor, a mechanical sensor, a position sensor, a thermal/heat sensor, an optical sensor, a light sensor or the like.

As will be discussed in greater detail later, if it is determined that the motorized vehicle 100 has collided in the front with an obstacle (such as motorized vehicle 102) or another motorized vehicle 100, then a point value (such as one (1) point)) may be deducted from that particular motorized vehicle 100. Conversely, if it is determined that the motorized vehicle 100 has been impacted in the back by another motorized vehicle 100, then a point value (such as one (1) point)) may not be deducted from that particular motorized vehicle 100.

Figure 4:
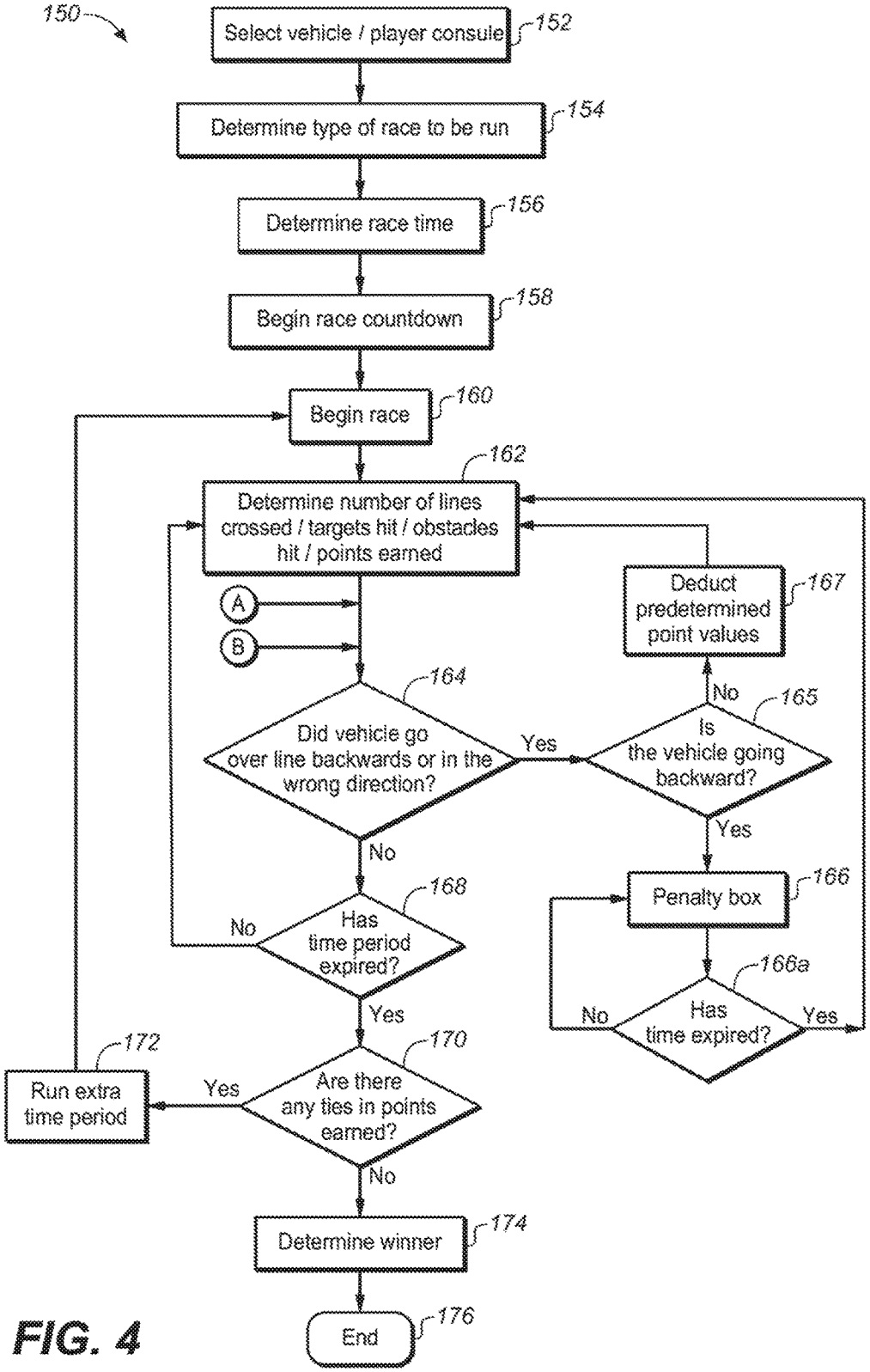
FIG. 4 is a flow chart that illustrates the method of playing the remote-control race game system, according to the present invention.
Figure 4A:
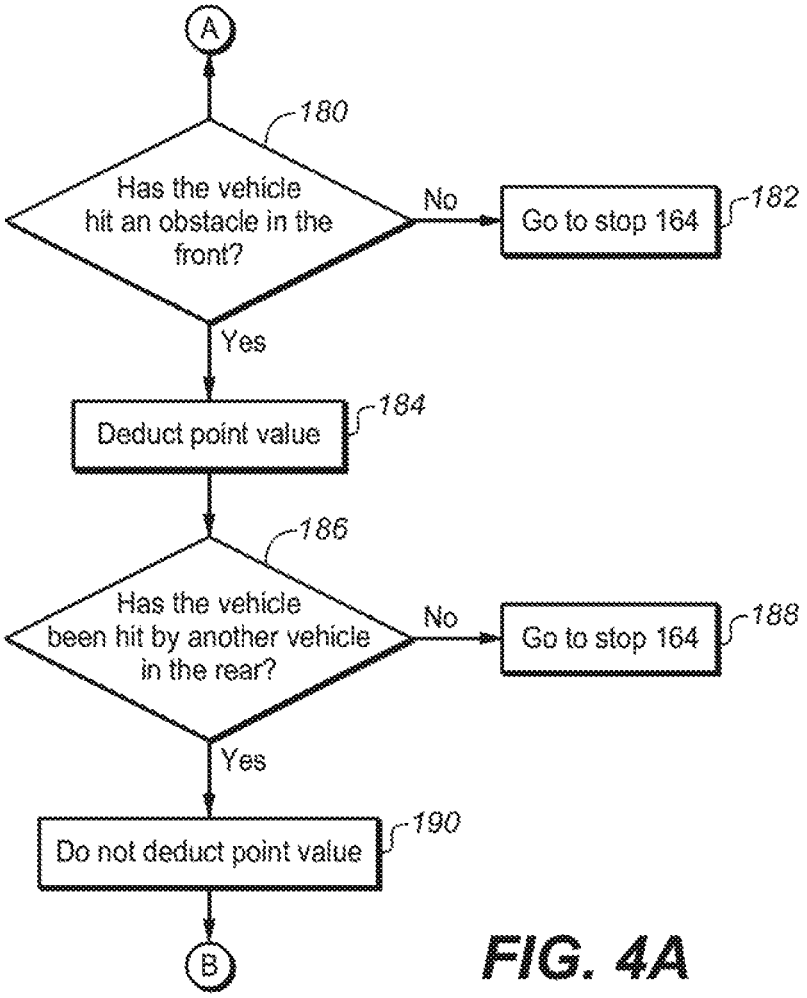
FIG. 4*a* is a flow chart that illustrates the steps of determining if a particular motorized vehicle has collided with an obstacle in the front or if the motorized vehicle has been impacted in the rear by another motorized vehicle, according to the present invention.

Considering now the method 150 of operating the remote-control race game system 10 in greater detail with reference to FIGS. 1-4*a*, after the number of players/drivers to play the remote-control race game has been determined, each player/driver selects a desired vehicle/player console 200 (step 152 in FIG. 4). It is to be understood that, for example, if there are a total of eight (8) vehicle/player consoles 200 available for use and only six (6) players/drivers are participating in a particular race, then either the other two (2) motorized vehicles 102 are used as stationary obstacles during the race or the race control system 300 can be used as the player/driver of the other two (2) motorized vehicles 100.

In step 154, the type of race to be run is then determined. In this step, the players/drivers can select, for example, the type and number of predetermined targets 50 located on race playfield 20. Also, the location(s) of the predetermined targets 50 can be determined. Further, the direction of travel (arrows A and B in FIG. 1) of the motorized vehicles 100 can be determined. Finally, the layout of the race playfield 20 can be determined. For example, the race playfield 20 can be configured to be an oval, a circle, a circuitous shape to resemble a road race playfield, an obstacle course or the like.

As shown in step 156, the amount of race time for a particular race is then determined by the race game system operator and/or the players/drivers.

Once all of the preliminary race set up has been determined in steps 152-156, the race game system operator will then begin the race countdown, as shown in step 158. In this step, a conventional countdown timer (not shown) or countdown light emitter with digital audio sound effects will be utilized to signify when the race has begun, as shown in step 160.

At this point, the race is in action and the attention of the race is turned to the action going on at the race playfield 20. As shown in step 162, race vehicle player consoles 200 and race control system 300 are used to keep track of (count) the number of predetermined targets 50 that have been crossed over or through or otherwise interacted with by a particular motorized vehicle 100. Also, race vehicle player consoles 200 and race control system 300 are used to keep count of the number of obstacles (such as stationary vehicles 102) that have been hit by a particular motorized vehicle 100, as will be discussed in greater detail later. In this manner, every time that a predetermined target 50 is crossed over or through or otherwise interacted with by a particular motorized vehicle 100, the player/driver of that particular motorized vehicle 100 is awarded a point, for example. Conversely, if that particular motorized vehicle 100 hits or otherwise comes into contact with an obstacle on the race playfield 20, then, for example, one (1) point is deducted from the player/driver who was driving that particular motorized vehicle 100.

Another unique aspect of the present invention will now be discussed with reference to step 164. As previously discussed, assume that the motorized vehicles 100 are supposed to travel around race playfield 20 in the direction of arrow (A). However, if a particular motorized vehicle 100 gets turned around (either intentionally or unintentionally) and starts travelling around race playfield 20 in the direction of arrow (B) or is backing up to get around an obstacle such as a stationary vehicle 102 (the direction of arrow (B)), the motorized vehicle 100 will then detect the presence of the thin line section 56 of a particular line 52 and then the wide line section 54 of the particular line 52, as discussed in the previous exemplary predetermined target 50 embodiment. If this occurs, the player/driver of that particular motorized vehicle 100 is either placed in the penalty box or one (1) point is deducted.

More particularly, if the motorized vehicle 100 has traveled in the wrong direction (the direction of arrow (B)) and crossed over or through or otherwise encountered more than two (2) predetermined targets 50, for example, as determined in step 165, than that particular motorized vehicle 100 is "black-flagged" and put into the penalty box, as shown in step 166.

The penalty box consists, preferably, of the particular motorized vehicle 100 being stopped, turned in the correct direction of travel around race playfield 20 and impeded from continuing in the race for a period of time, such as ten (10) seconds. For example, the "black-flagged" motorized vehicle 100 is disabled by shutting down that particular motorized vehicle's motor 108 and/or disabling the steering mechanism of that particular motorized vehicle 100. As shown in step 166*a*, it is determined if there is still time left for the "black-flagged" or penalty period. Once the penalty time has expired, that particular "penalized" motorized vehicle 100 is then allowed to re-enter the race, as shown in step 162.

If it is determined by the race vehicle player console 200 and race control system 300 that the particular motorized vehicle 100 has simply backed up over a predetermined target 50, for example, in order to get around an obstacle such as a stationary vehicle 102, that particular motorized vehicle is not "black-flagged" and placed in the penalty. Instead, the player/driver of that particular motorized vehicle 100 has, for example, one (1) point deducted from his/her score, as shown in step 167. It is to be understood that in order to determine if a motorized vehicle 100 has only backed up in order to get around an obstacle, it is assumed that if the motorized vehicle 100 has only traveled in the wrong direction (arrow (B)) and crossed over or through or otherwise interacted, for example, with only one (1) predetermined target 50, then that particular motorized vehicle 100 is deemed to have only backed up.

In another unique aspect of the present invention, as shown in step 180, if a particular motorized vehicle 100 has collided with an obstacle (such as motorized vehicle 102) or another motorized vehicle 100, then a point value (such as one (1) point) is deducted from the player/driver of that particular motorized vehicle, as shown in step 184. If it has been determined that the particular motorized vehicle 100 has not collided with any obstacles or other motorize vehicles 100, then the process proceed back to step 164, as shown in step 182.

On the other hand, as shown in step 186, if a particular motorized vehicle 100 been impacted or otherwise struck in the rear by another motorized vehicle 100, then a point value (such as one (1) point) is not deducted from the player/driver of that particular motorized vehicle, as shown in step 190). If it has been determined that the particular motorized vehicle 100 has not been impacted or otherwise struck in the rear by another motorized vehicle 100, then the process proceed back to step 164, as shown in step 188.

All the while during the running of the race, the race control system 300 is determining if the pre-set amount of time for that particular race has expired, as shown in step 168. Clearly, if there is still time left in the race, the race continues and the system proceeds back to step 162.

Once the time period for the race has expired, the race control system 300 then determines if at least two (2) of the players/drivers have the same high score, as shown in step 170.

If it is determined that at least two (2) of the players/drivers have the same high score, then the players/drivers who have the same high score will run another race to determine the overall winner, as shown in step 172. In this step, an extra time (overtime) period, for example, of five (5) minutes will be added and the method proceeds back to step 160. The overtime race will be run according to all of the steps and rules as discussed earlier until only one (1) player/driver having the highest score remains.

As shown in step 174, once there is only one (1) player/driver that has the highest score, then that particular race is concluded.

Finally, it is to be understood that while the exemplary embodiments described herein have included actual implementations of the remote-control race game system, other exemplary embodiments may include electronic gaming devices and electronic systems (such as, but not limited to, the Internet, mobile phones, tablets, gaming devices, slot machines, computers, etc.). It is within the scope of this disclosure to implement games utilizing electronic components or printed materials. For example, exemplary games may be played on a personal computer, game system, or gaming machine in a stand-alone capacity or utilizing a communications network, such as the Internet. As an example, computers and/or game systems may be utilized to play exemplary games where the players are geographically separated, and exemplary games may be played on networked personal computers. In other embodiments, exemplary games may be played utilizing mobile devices, such as mobile phones, tablets, personal digital assistants, or portable video game devices, for example. In a stand-alone or networked capacity, exemplary games may be provided on electronic equipment adapted specifically for gaming. Such devices may be used, for example, in a video game arcade, a bar/restaurant, and/or a casino. It is to be understood that implementations of games on electronic systems may include representations of representations of any aspect of a game, including any motorized vehicles, race tracks, predetermined targets, obstacles, stationary vehicles, etc.

Exemplary methods may be implemented in the general context of non-transitory computer-executable instructions that may run on one or more computers, and exemplary methods may also be implemented in combination with program modules and/or as a combination of hardware and software. Generally, program modules include routines, programs, components, data structures, etc., that perform particular tasks or implement particular abstract data types. Moreover, those skilled in the art will appreciate that exemplary methods can be practiced using or with other computer system configurations, including single-processor or multiprocessor computer systems, minicomputers, mainframe computers, as well as personal computers, hand-held computing devices, microprocessor-based or programmable consumer electronics, and the like, each of which can be operatively coupled to one or more associated devices. Exemplary methods may also be practiced in distributed computing environments where certain tasks are performed by remote processing devices that are linked through a communications network. In a distributed computing environment, program modules can be located in both local and remote memory storage devices.

An exemplary computer typically includes a variety of computer readable media. Computer readable media can be any available media that can be accessed by the computer and includes transitory and non-transitory media, removable and non-removable media. By way of example, and not limitation, computer-readable media can comprise computer storage media and communication media. Computer storage media includes transitory and non-transitory, removable and non-removable media implemented in any method or technology for storage of information such as computer-readable instructions, data structures, program modules or other data. Computer storage media includes, but is not limited to, RAM, ROM, EEPROM, flash memory or other memory technology, CD ROM, digital video disk (DVD) or other optical disk storage, magnetic cassettes, magnetic tape, magnetic disk storage or other magnetic storage devices, or any other medium which can be used to store the desired information and which can be accessed by the computer.

The preceding merely illustrates the principles of the invention. It will thus be appreciated that those skilled in the art will be able to devise various arrangements which, although not explicitly described or shown herein, embody the principles of the invention and are included within its spirit and scope. Furthermore, all examples and conditional language recited herein are principally intended expressly to be only for pedagogical purposes and to aid the reader in understanding the principles of the invention and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure.

This description of the exemplary embodiments is intended to be read in connection with the figures of the accompanying drawing, which are to be considered part of the entire written description. In the description, relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

All patents, publications, scientific articles, web sites, and other documents and materials referenced or mentioned herein are indicative of the levels of skill of those skilled in the art to which the invention pertains, and each such referenced document and material is hereby incorporated by reference to the same extent as if it had been incorporated by reference in its entirety individually or set forth herein in its entirety.

The applicant reserves the right to physically incorporate into this specification any and all materials and information from any such patents, publications, scientific articles, web sites, electronically available information, and other referenced materials or documents to the extent such incorporated materials and information are not inconsistent with the description herein.

The written description portion of this patent includes all claims. Furthermore, all claims, including all original claims as well as all claims from any and all priority documents, are hereby incorporated by reference in their entirety into the written description portion of the specification, and Applicant(s) reserve the right to physically incorporate into the written description or any other portion of the application, any and all such claims. Thus, for example, under no circumstances may the patent be interpreted as allegedly not providing a written description for a claim on the assertion that the precise wording of the claim is not set forth in haec verba in written description portion of the patent.

The claims will be interpreted according to law. However, and notwithstanding the alleged or perceived ease or difficulty of interpreting any claim or portion thereof, under no circumstances may any adjustment or amendment of a claim or any portion thereof during prosecution of the application or applications leading to this patent be interpreted as having forfeited any right to any and all equivalents thereof that do not form a part of the prior art.

All of the features disclosed in this specification may be combined in any combination. Thus, unless expressly stated otherwise, each feature disclosed is only an example of a generic series of equivalent or similar features.

It is to be understood that while the invention has been described in conjunction with the detailed description thereof, the foregoing description is intended to illustrate and not limit the scope of the invention, which is defined by the scope of the appended claims. Thus, from the foregoing, it will be appreciated that, although specific embodiments of the invention have been described herein for the purpose of illustration, various modifications may be made without deviating from the spirit and scope of the invention. Other aspects, advantages, and modifications are within the scope of the following claims and the present invention is not limited except as by the appended claims.

The specific methods and compositions described herein are representative of preferred embodiments and are exemplary and not intended as limitations on the scope of the invention. Other objects, aspects, and embodiments will occur to those skilled in the art upon consideration of this specification, and are encompassed within the spirit of the invention as defined by the scope of the claims. It will be readily apparent to one skilled in the art that varying substitutions and modifications may be made to the invention disclosed herein without departing from the scope and spirit of the invention. The invention illustratively described herein suitably may be practiced in the absence of any element or elements, or limitation or limitations, which is not specifically disclosed herein as essential. Thus, for example, in each instance herein, in embodiments or examples of the present invention, the terms "comprising", "including", "containing", etc. are to be read expansively and without limitation. The methods and processes illustratively described herein suitably may be practiced in differing orders of steps, and that they are not necessarily restricted to the orders of steps indicated herein or in the claims.

The terms and expressions that have been employed are used as terms of description and not of limitation, and there is no intent in the use of such terms and expressions to exclude any equivalent of the features shown and described or portions thereof, but it is recognized that various modifications are possible within the scope of the invention as claimed. Thus, it will be understood that although the present invention has been specifically disclosed by various embodiments and/or preferred embodiments and optional features, any and all modifications and variations of the concepts herein disclosed that may be resorted to by those skilled in the art are considered to be within the scope of this invention as defined by the appended claims.

The invention has been described broadly and generically herein. Each of the narrower species and sub-generic groupings falling within the generic disclosure also form part of the invention. This includes the generic description of the invention with a proviso or negative limitation removing any subject matter from the genus, regardless of whether or not the excised material is specifically recited herein.

It is also to be understood that as used herein and in the appended claims, the singular forms "a," "an," and "the" include plural reference unless the context clearly dictates otherwise, the term "X and/or Y" means "X" or "Y" or both "X" and "Y", and the letter "s" following a noun designates both the plural and singular forms of that noun. In addition, where features or aspects of the invention are described in terms of Markush groups, it is intended and those skilled in the art will recognize, that the invention embraces and is also thereby described in terms of any individual member or subgroup of members of the Markush group.

Other embodiments are within the following claims. Therefore, the patent may not be interpreted to be limited to the specific examples or embodiments or methods specifically and/or expressly disclosed herein. Under no circumstances may the patent be interpreted to be limited by any statement made by any Examiner or any other official or employee of the Patent and Trademark Office unless such statement is specifically and without qualification or reservation expressly adopted in a responsive writing by Applicants.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

Other modifications and implementations will occur to those skilled in the art without departing from the spirit and the scope of the invention as claimed. Accordingly, the description hereinabove is not intended to limit the invention, except as indicated in the appended claims.

Therefore, provided herein is a new and improved remote-control race game system. The preferred remote-control race game system, according to various embodiments of the present invention, offers the following advantages: ease of operation; ease of use; durability; excellent race game characteristics; the ability to sense when the motorized vehicle has crossed over or through the predetermined target(s); the ability to provide information to the player/driver as to the number of predetermined targets that have been crossed over or through by that particular player/driver's motorized vehicle; the ability to control the speed of each player/driver's motorized vehicle so that all of the motorized vehicles are traveling at the same speed; the ability to provide a penalty box for those players/drivers that drive their vehicles in the wrong direction; the ability to deduct points from those players/drivers that back up their vehicle; and the ability to adjust the remote-control race game system to adjust to the ability of the players/drivers. In fact, in many of the preferred embodiments, these advantages of ease of operation, ease of use, durability, excellent race game characteristics, the ability to sense when the motorized vehicle has crossed over or through the predetermined target(s), the ability to provide information to the player/driver as to the number of predetermined targets that have been crossed over or through by that particular player/driver's motorized vehicle, the ability to control the speed of each player/driver's motorized vehicle so that all of the motorized vehicles are traveling at the same speed, the ability to provide a penalty box for those players/drivers that drive their vehicles in the wrong direction, the ability to deduct points from those players/drivers that back up their vehicle, and the ability to adjust the remote-control race game system to adjust to the ability of the players/drivers are optimized to an extent that is considerably higher than heretofore achieved in prior, known remote-control race game systems.

I claim:

1. A method of racing remote-controlled motorized vehicles, comprising the steps of:

determining a number of players/drivers to participate in a remote-control motorized vehicle race;

selecting, by each player/driver, a motorized vehicle/player console, wherein each motorized vehicle/player console remotely controls a particular motorized vehicle;

determining an amount of time for the remote-control motorized vehicle race;

determining a type and number of a plurality of predetermined targets located on a race playfield;

determining the locations of the plurality of predetermined targets;

determining the number of predetermined targets that have been crossed over or through by each of the particular motorized vehicles on the race playfield;

determining if the particular motorized vehicle has traveled in a wrong direction;

determining if the particular motorized vehicle has crossed over or through at least two predetermined targets in the wrong direction such that if the particular motorized vehicle has crossed over or through at least two predetermined targets in the wrong direction the particular motorized vehicle is disabled for a predetermined period of time by shutting down a motor of the particular motorized vehicle by a race control system;

determining if the particular motorized vehicle has collided with an obstacle or another motorized vehicle;

determining if the amount of time for the remote-control motorized vehicle race has expired;

determining the number of points earned by each of the particular motorized vehicles; and determining which of the particular motorized vehicles earned the most number of points.

2. The method, as in claim 1, wherein the method is further comprised of the step of:

determining a layout of the playfield upon which the predetermined targets are to be located.

3. The method, as in claim 1, wherein the step of determining the number of predetermined targets that have been crossed over or through by each of the particular motorized vehicles is further comprised of the step of:

awarding a point value for each of the predetermined targets that have been crossed over or through by each of the particular motorized vehicles.

4. The method, as in claim 1, wherein the step of determining the number of predetermined targets that have been crossed over or through by each of the particular motorized vehicles is further comprised of the step of:

determining if the particular motorized vehicle has backed up.

5. The method, as in claim 4, wherein the step of determining if the particular motorized vehicle has backed up is further comprised of the step of:

determining if the particular motorized vehicle has crossed over or through only one predetermined target in the wrong direction.

6. The method, as in claim 5, wherein the step of determining if the particular motorized vehicle has backed up is further comprised of the step of:

deducting a point value if it is determined that the particular motorized vehicle has backed up.

7. The method, as in claim 1, wherein the step of determining the number of points earned by each of the particular motorized vehicles is further comprised of the steps of:

determining if more than one of the number of players/drivers has earned the same number of points;

determining the amount of extra time to be run in an extra time period;

conducting another race; and determining, again, if more than one of the number of players/drivers has earned the same number of points.

8. A method of operating remote-control motorized vehicles to simulate a race, comprising the steps of:

determining a number of players/drivers to participate in a remote-control motorized vehicle race;

selecting, by each player/driver, a motorized vehicle/player console, wherein each motorized vehicle/player console remotely controls a particular motorized vehicle;

determining an amount of time for the remote-control motorized vehicle race;

determining a type and number of a plurality of predetermined targets located on a race playfield;

determining the locations of the plurality of predetermined targets;

determining the number of predetermined targets that have been crossed over or through by each of the particular motorized vehicles on the race playfield;

determining if the particular motorized vehicle has traveled in a wrong direction;

determining if the particular motorized vehicle has crossed over or through at least two predetermined targets in the wrong direction such that if the particular motorized vehicle has crossed over or through at least two predetermined targets in the wrong direction the particular motorized vehicle is disabled for a predetermined period of time by shutting down a motor of the particular motorized vehicle by a race control system;

determining if the particular motorized vehicle has collided with an obstacle or another motorized vehicle;

determining if the amount of time for the remote-control motorized vehicle race has expired;

determining the number of points earned by each of the particular motorized vehicles; and determining which of the particular motorized vehicles earned the most number of points.

9. The method, as in claim 8, wherein the step of determining the number of predetermined targets that have been crossed over or through by each of the particular motorized vehicles is further comprised of the step of:

awarding a point value for each of the predetermined targets that have been crossed over or through by each of the particular motorized vehicles.

10. The method, as in claim 8, wherein the step of determining the number of predetermined targets that have been crossed over or through by each of the particular motorized vehicles is further comprised of the step of:

determining if the particular motorized vehicle has backed up.

11. The method, as in claim 10, wherein the step of determining if the particular motorized vehicle has backed up is further comprised of the step of:

determining if the particular motorized vehicle has crossed over or through only one predetermined target in the wrong direction.

12. A remote-control motorized vehicle racing system, comprising:

a plurality of remote-control motorized vehicles, each selectively controlled by one a plurality of players, wherein each of the plurality of motorized vehicles includes a predetermined target sensor, wherein each of the motorized vehicles includes a front collision sensor and a rear collision sensor;

a plurality of motorized vehicle race vehicle player consoles each operatively connected to one of the plurality of motorized vehicles, wherein each of the motorized vehicle race vehicle player consoles includes a steering mechanism and a propulsion control;

a race playfield, wherein the race playfield further includes a plurality of predetermined targets located at predetermined locations around the race playfield such that the plurality of predetermined targets can be crossed over or through by the motorized vehicle and the plurality of predetermined targets can be detected by the predetermined target sensor of the motorized vehicle; and a race control system operatively connected to the plurality of motorized vehicles and the plurality of race vehicle player consoles, wherein if one of the plurality of motorized vehicles has crossed over or through at least two predetermined targets in a wrong direction, the one of the plurality of motorized vehicles is disabled for a predetermined period of time by shutting down the steering mechanism of the one of the plurality motorized vehicles by the race control system.

13. The remote-control motorized vehicle racing system, as in claim 12, wherein the plurality of predetermined targets is further comprised of:

a plurality of lines such that each of the lines includes a wide line section and a thin line section.

* * * * *